US009908728B2

(12) United States Patent
Persson

(10) Patent No.: US 9,908,728 B2
(45) Date of Patent: Mar. 6, 2018

(54) APPARATUS FOR DISPENSING ABSORBENT SHEET PRODUCTS AND METHOD FOR MODIFYING SUCH APPARATUS

(75) Inventor: Daniel Persson, Vasteras (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 17 days.

(21) Appl. No.: 13/808,262

(22) PCT Filed: Jul. 7, 2010

(86) PCT No.: PCT/EP2010/059712

§ 371 (c)(1),
(2), (4) Date: Jan. 4, 2013

(87) PCT Pub. No.: WO2012/003865

PCT Pub. Date: Jan. 12, 2012

(65) Prior Publication Data

US 2013/0105613 A1 May 2, 2013

(51) Int. Cl.
*B65H 16/00* (2006.01)
*A47K 10/36* (2006.01)

(52) U.S. Cl.
CPC ..... *B65H 16/005* (2013.01); *A47K 10/36* (2013.01); *B65H 2301/5133* (2013.01)

(58) Field of Classification Search
CPC ..... B65H 2301/5133; B65H 16/005; Y10S 242/906; H05F 3/00; H05F 3/02; H05F 3/04; A47K 10/36
USPC ... 242/563, 563.1, 564, 564.1, 564.3, 564.4, 242/565, 906
See application file for complete search history.

(56) References Cited

U.S. PATENT DOCUMENTS 1,396,318 A * 11/1921 Bunger ..... B41F 23/00 361/214
2,839,345 A * 6/1958 Engel et al. ..... 225/16
2,879,396 A * 3/1959 McDonald ..... 250/324
2,945,434 A * 7/1960 Eichler ..... B22F 9/12 101/232

(Continued)

FOREIGN PATENT DOCUMENTS

CN 101529994 A 9/2009
DE 2146539 A1 3/1973

(Continued)

OTHER PUBLICATIONS

Decision on Grant Patent for Invention dated May 28, 2014 is Russian Patent Application No. 2013104984/12.

(Continued)

*Primary Examiner* — Michael E Gallon
(74) *Attorney, Agent, or Firm* — Drinker Biddle & Reath LLP

(57) ABSTRACT

An apparatus for dispensing absorbent sheet products includes a store with an absorbent web which is to be dispensed, a conveying mechanism with at least one conveying element for feeding the absorbent web and a mechanism for severing the web so as to form absorbent sheet products. The apparatus further includes a mechanism for collecting electrical charges caused by static electricity, a mechanism for directing electrical charges to another element within the apparatus for dispensing, and a mechanism for neutralising or consuming the electrical charges.

12 Claims, 3 Drawing Sheets

(56) References Cited

U.S. PATENT DOCUMENTS 3,396,917 A * 8/1968 Carter ..... H05F 3/00 242/564.4
3,542,578 A * 11/1970 Lang ..... H05F 3/00 101/483
3,628,749 A * 12/1971 Ort et al. ..... 242/332.2
3,636,408 A * 1/1972 Shuman ..... H05F 3/02 225/6
3,670,203 A * 6/1972 Whitmore, Jr. ..... H05F 3/04 361/214
3,757,164 A * 9/1973 Binkowski ..... H05F 3/02 361/212
3,792,312 A 2/1974 Marx
3,863,241 A * 1/1975 Kamiyamaguchi et al. . 307/116
3,904,929 A * 9/1975 Kanaya ..... F16L 11/127 361/220
3,981,459 A * 9/1976 Urbanek ..... B82Y 15/00 226/195
4,307,432 A * 12/1981 Nishikawa ..... 361/221
4,352,143 A * 9/1982 Uno ..... H05F 3/02 15/1.51
4,363,070 A * 12/1982 Kisler ..... H05F 3/02 361/212
4,494,166 A * 1/1985 Billings ..... B41J 29/00 361/214
4,615,493 A * 10/1986 Teranishi et al. ..... 242/473.7
4,696,562 A * 9/1987 Urata ..... G03G 15/221 399/377
4,737,809 A * 4/1988 Konno ..... G03B 1/58 361/220
4,751,548 A * 6/1988 Lawson ..... G03G 15/2025 118/260
4,831,488 A * 5/1989 Playe ..... H05F 3/04 361/221
4,860,159 A * 8/1989 Rodrigo ..... 361/212
4,960,248 A * 10/1990 Bauer et al. ..... 242/564.4
5,041,941 A * 8/1991 Carter ..... H05F 3/04 361/214
5,121,285 A * 6/1992 McClure ..... G03G 15/6591 361/212
5,184,180 A * 2/1993 Choi ..... G03G 15/1675 399/222
5,228,373 A * 7/1993 Welsch ..... B65H 5/004 271/208
5,302,037 A * 4/1994 Schoendienst et al. ..... 400/586
5,354,607 A * 10/1994 Swift ..... G03G 15/75 310/248
5,377,069 A * 12/1994 Andreasson ..... H05F 3/00 361/212
5,400,208 A * 3/1995 Pazda ..... H05F 3/02 271/208
5,452,832 A * 9/1995 Niada ..... 225/11
5,469,322 A * 11/1995 Seo ..... H05F 3/02 361/220
5,478,061 A * 12/1995 Murakami ..... G03G 15/6573 270/58.08
5,526,973 A * 6/1996 Boone et al. ..... 225/34
5,828,918 A * 10/1998 Abe ..... G03B 17/00 396/439
5,860,344 A * 1/1999 Yamamoto et al. ..... 83/365
5,996,925 A * 12/1999 Iwade et al. ..... 242/413.1
6,048,119 A * 4/2000 Kato et al. ..... 400/624
6,069,354 A * 5/2000 Alfano et al. ..... 250/221
6,252,757 B1 * 6/2001 Loughney et al. ..... 361/221
6,314,850 B1 * 11/2001 Morand ..... 83/327
6,367,727 B1 * 4/2002 Sasou et al. ..... 242/348.1
6,498,913 B1 * 12/2002 Tooker ..... G03G 15/754 361/214
6,604,876 B2 * 8/2003 Bryant ..... B41J 2/325 347/214
6,871,815 B2 * 3/2005 Moody et al. ..... 242/559.2
6,920,030 B2 * 7/2005 Chase ..... H05F 3/02 361/214
7,017,856 B2 3/2006 Moody et al.
7,040,566 B1 * 5/2006 Rodrian et al. ..... 242/563
7,168,653 B2 * 1/2007 Omdoll ..... B65H 35/0006 242/564.2
7,237,744 B2 * 7/2007 Morris et al. ..... 242/560.1
7,708,271 B2 * 5/2010 Major, Jr. ..... B65H 31/00 271/208
7,845,593 B2 * 12/2010 Formon et al. ..... 242/560.1
7,946,522 B2 * 5/2011 Lewis et al. ..... 242/564.1
8,082,828 B2 * 12/2011 Formon et al. ..... 83/649
8,320,817 B2 * 11/2012 Zaretsky ..... G03G 15/6573 399/405
8,730,643 B2 * 5/2014 Formon ..... H05F 3/02 361/214
2002/0081123 A1 * 6/2002 Nishimura ..... G03G 21/0035 399/98
2002/0109034 A1 * 8/2002 Moody et al. ..... 242/559.1
2002/0109035 A1 * 8/2002 Denen et al. ..... 242/559.1
2002/0109036 A1 * 8/2002 Denen et al. ..... 242/560
2003/0062438 A1 * 4/2003 Murao et al. ..... 242/346.2
2003/0202830 A1 * 10/2003 Oh ..... B65H 37/00 399/390
2004/0178297 A1 * 9/2004 Moody et al. ..... 242/564.4
2006/0169827 A1 * 8/2006 Lewis et al. ..... 242/563
2007/0109385 A1 * 5/2007 Imoto ..... B41J 3/60 347/104
2007/0234868 A1 * 10/2007 Formon ..... A47K 10/36 83/649
2008/0087758 A1 * 4/2008 Formon et al. ..... 242/563
2008/0099595 A1 * 5/2008 Lewis et al. ..... 242/560
2008/0105364 A1 * 5/2008 Hawkins et al. ..... 156/172
2008/0192403 A1 8/2008 Chen
2008/0206512 A1 * 8/2008 Chernyak et al. ..... 428/88
2008/0230647 A1 * 9/2008 Moody et al. ..... 242/564
2010/0025509 A1 * 2/2010 Matlin et al. ..... 241/100
2010/0133288 A1 * 6/2010 Formon ..... A47K 10/34 221/45
2012/0099911 A1 * 4/2012 Zaretsky ..... G03G 15/6573 399/406
2012/0325688 A1 * 12/2012 Davis ..... A46B 15/0055 206/38
2014/0362153 A1 * 12/2014 Haginoya ..... G03G 15/04 347/118
2015/0054215 A1 * 2/2015 Sato ..... B65H 43/06 271/208
2015/0098744 A1 * 4/2015 Nakanishi ..... B41J 29/13 399/405

FOREIGN PATENT DOCUMENTS

DE 29 50 192 7/1980
JP 2003-100496 A 4/2003
KR 10-2005-0004329 1/2005
SU 1061101 A1 12/1983
SU 1228308 A1 4/1986
WO 2008/053393 5/2008
WO 2008/125127 10/2008

OTHER PUBLICATIONS

A search report or other listing of documents from a related Russian Patent Application with the Serial No. 2013104984 dated May 28, 2014.

Chinese Office Action dated Feb. 22, 2017 issued in corresponding Chinese patent application No. 201080067924.3 (10 pages) and its English-language translation thereof (10 pages).

* cited by examiner

Fig. 3
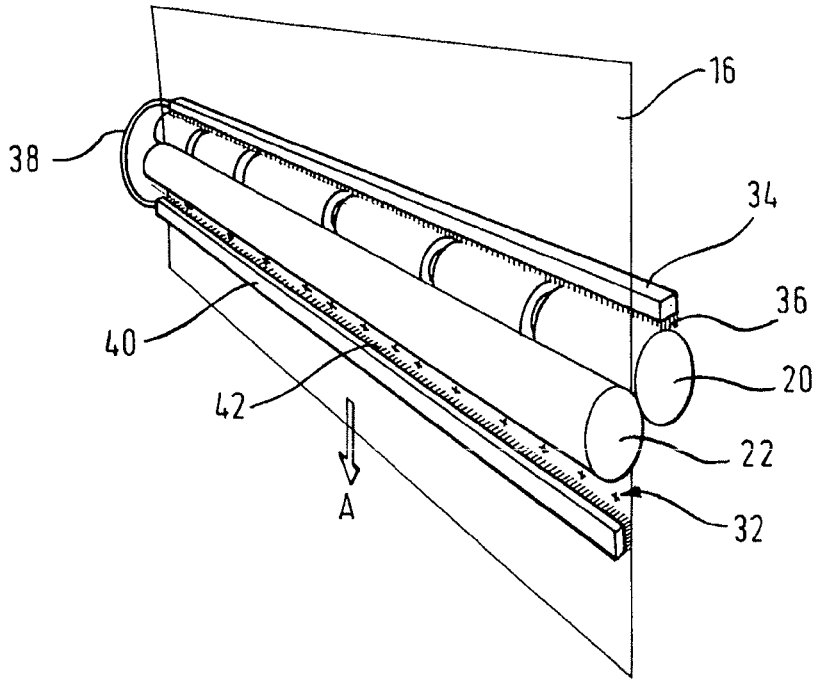
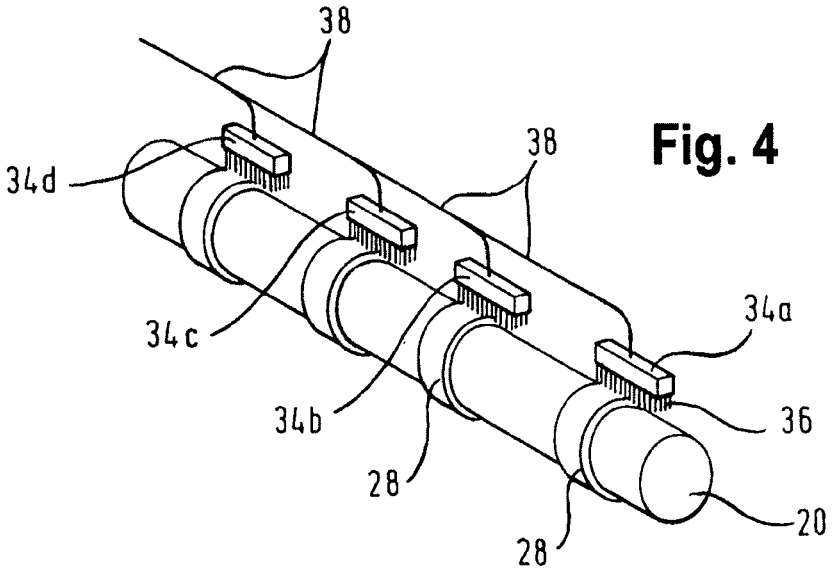
Fig. 4

APPARATUS FOR DISPENSING ABSORBENT SHEET PRODUCTS AND METHOD FOR MODIFYING SUCH APPARATUS

CROSS-REFERENCE TO PRIOR APPLICATION

This application is a § 371 National Stage Application of PCT International Application No. PCT/EP2010/059712 filed Jul. 7, 2010, which is incorporated herein in its entirety.

TECHNICAL FIELD

The disclosure relates to an apparatus for dispensing absorbent sheet products including a store with an absorbent web, a conveying means for feeding the absorbent web and means for severing the web so as to form absorbent sheet products. The disclosure further relates to a method for modifying an apparatus for dispensing absorbent sheet products of this kind.

BACKGROUND ART

Dispensers for absorbent sheet products are well-known in the art. Such apparatus comprise a store with an absorbent web which is to be dispensed. The web is conveyed with at least one conveying element for feeding the absorbent web to a position where it is cut so as to form separate absorbent sheet products for a user. In dispensers for absorbent material, like tissue material, a build-up of electrostatic charge can be observed. When two bodies of different material are in contact which each other, there is migration of electrons between the two surfaces. The number of electrons that migrate is dependent on the difference in the so-called work function of the two materials. The term "work function" stands for the energy required to remove an electron from the surface of a specific material to infinite. A material with a lower work function acts as a donor. From such donor material, the electrons migrate to the acceptor material with the higher work function. If the two bodies suddenly are separated from each other, the electrons try to return to their parent material. In the cases where the material is conductive, this is possible and the electrons migrate back to their parent material. However, if one or both of the two bodies are insulating materials, this will not happen. As a result, electrons get trapped in the surface of the material to which they have migrated.

Static electricity generates high voltages with low currents. Commonly accepted Standard IEC 61000-4-2 limits the allowable maximum voltage level to an amount smaller than +/−8000V. If the electrostatic charge exceeds such maximum voltage, it might affect other electrical components. Further, it is even possible that a user might be exposed to unpleasant discharges.

Various factors influence the build-up of electrostatic charges. The first factor is the type of material. In order to create an electrostatic build-up, two bodies have to be in contact with each other, where at least one of the bodies should be a bad conductor. When there are two bodies of dissimilar material it could cause the material to charge even more than when two similar materials are in contact with each other. This is the effect of the dielectric constant, or the work function. A material with high relative permittivity (the electric constant) becomes positively charged when it is separated from a material with low permittivity. A second factor is the contact area between dissimilar materials. The larger the contact area is, the more electrons migrate between the materials. As a result of this, a large contact area promotes a high electrostatic charge build-up. A third factor is the separation speed. The higher the speed of separation of the two materials is, the less is the possibility for the electrons to move back to the parent material. A higher separation speed results in a higher charge build-up. A further factor of influence is a possible motion between the materials. Firstly, the local heat generated by the friction between materials increases the energy level of the atoms making the escape of electrons easier. Secondly, a movement causes better surface contact by bringing the microscopic irregularities on both surfaces in contact with each other thus increasing the possibility of the electrons to migrate from one material to the other. The same applies for a higher temperature which results in easier release of electrons due to the higher energy level. Finally, atmospheric conditions can also influence the build-up of electrostatic charge. The more moisture there is in the atmosphere, the better is the ability of discharge. However, this is not true for all materials. For dispensers of the kind as stated above, however, the observation has been made that the electrostatic build-up tends to be higher in winter where the relative humidity of the ambient air is usually smaller.

Measurements show that the parts in a conventional dispenser which generate electrostatic charges are the conveying rolls and the knife or tear bar for severing the web into individual sheets. The paper leaves a dispenser positively charged so that the dispenser apparatus itself experiences a build-up of negative electrostatic charges.

U.S. Pat. Nos. 6,871,815 and 7,017,856 propose a system wherein a low impedance, high conductivity pathway, like a wire, is used to connect internal components of the dispenser that are subject to static charge build-up to a mechanical contact on the back of the dispenser housing. This contact, in turn, makes contact with the supporting wall upon which the dispenser is mounted, with the premise being that any static charge will be dissipated by the wall.

WO2008/053393 describes an electronic dispenser incorporating a passive, self-discharging static charge dissipating material incorporated with at least an internal component within the internal volume of the housing that stores static charge generated by operation of the dispenser. The web material is directed over the static charge dissipating material as it is conveyed through the dispenser in order to reduce the electrostatic load of the web material leaving the dispenser.

SUMMARY

It is desired to provide an apparatus for dispensing absorbent sheet products which, by simple means, effectively reduces the problems associated with electrostatic build-up. This can be solved by an apparatus according to this disclosure as well as methods for modifying an apparatus for dispensing according to this disclosure.

A first aspect includes an apparatus for dispensing absorbent sheet products including a store with an absorbent web which is to be dispensed, a conveying means with at least one conveying element for feeding the absorbent web, and means for severing the web so as to form absorbent sheet products. The apparatus further includes means for collecting electrical charges caused by static electricity, means for directing electrical charges to another element within the apparatus for dispensing, and means for neutralising and/or consuming the electrical charges.

The apparatus for dispensing is not limited to any particular type of dispenser and has utility for any dispenser wherein it is desired to neutralise or consume electrical charges caused by static charge build-up. The dispenser may be a "hands free" dispenser that is automatically actuated upon detection of an object placed within a defined detection zone. In alternative embodiments, the dispenser may be actuated upon the user pressing a bottom, switch or manual actuating device to initiate a dispense cycle. The dispenser may be as well of such type where the user grasps the absorbent material to be dispensed and pulls out a metered length of such absorbent material.

A store within the apparatus may be a roll on which an absorbent web is wound. It might as well be a store in which the web material is folded to a stack.

It is the basic idea of the disclosure to provide a means for collecting electrical charges, to direct such electrical charges by another suitable means to another part and element within the apparatus for dispensing, and to provide means for neutralising and/or consuming the electrical charges.

The method for modifying an apparatus for dispensing absorbent sheet products includes a store with an absorbent web which is to be dispensed, a conveying means with at least one conveying element for feeding the absorbent web and means for severing the web so as to form absorbent sheet products. The method includes the steps of (a) Placing means for collecting electrical charges caused by static electricity in contact with a first element inside the apparatus with a negative electrostatic charge;

(b) Placing means for neutralising the electrical charges in contact with a second element inside the apparatus with a positive electrostatic charge; and (c) Establishing an electrically conductive connection between the first element and the second element.

According to an alternative embodiment, the method for modifying such an apparatus as described above includes the steps of (1) Placing means for collecting electrical charges caused by static electricity in contact with a first element inside the apparatus with a negative electrostatic charge; and (2) Placing means for consuming the electrical charges in electrical contact to the first element, the means for consuming can include an LED.

According to the first above-mentioned method for modifying an apparatus for dispensing absorbent sheet products, the electrical charges collected by placing means for collecting in contact with an element inside the apparatus with a negative electrostatic charge are directed to another position inside the apparatus with a positive electrostatic charge where such excess charges (electrons) are conveyed to and introduced again into a positively charged material. In such a way, the build-up of static charges can be considerably reduced because, the higher the build-up in electrostatic charge is, the more effective becomes the system for collecting excess electrons and returning them to another element which has a positive electrostatic charge.

According to an alternative method or method used in combination with the first method, the electrical charges collected from an element inside the apparatus with a negative electrostatic charge are consumed. If this solution is selected, the absorbent sheet products will still leave the dispenser with a positive electrostatic charge. However, the build-up of a negative charge inside the dispenser can be considerably reduced by consuming such negative charges. An LED is a very suitable solution for achieving this. An LED will start to consume the charges at a voltage level of around 6000V which is below the allowable limit of 8000V.

According to a particular embodiment, the means for collecting electrical charges is attached to the means for severing the web, in particular a tear bar. Measurements in conventional dispensers have shown that the build-up of electrostatic charge at the tear bar is relatively high, presumably because of the high separation speed between the absorbent material to be dispensed and a tear bar. In case that the tear bar is arranged at a fixed position inside the dispenser or performs a relatively simple bidirectional movement, the electrostatic charges can be collected directly by means of a conductive strip in contact to the tear bar and a wire element attached to such conductive strip.

According to an alternative embodiment, the means for collecting electrical charges includes at least one brush element contacting a conveying element of the apparatus for dispensing, in particular a roller contacting the absorbent web. The conveying elements and especially rollers contacting the absorbent web have been identified to be especially prone to the build-up of electrostatic charges. This might be attributable to the pressure between such conveying elements and the corresponding friction between the conveying elements and the absorbent web. A brush element is especially suitable for contacting such rotating element and for collecting excess negative charges from such conveying element.

In particular embodiments, the at least one brush element extends along most of the length of the conveying element, the at least one brush element, in certain embodiments, being one single brush. According to an alternative embodiment, it is also possible to provide several separate brushes which are arranged at different positions of the conveying element, where the absorbent web contacts the conveying element in the course of the movement of the conveying element.

The use of one single brush element over the length of the conveying element is the simplest solution because the positioning of the brush element and the associated wiring is very simple to arrange. Since the static build-up is highest for materials which have a small electric conductivity, it is not possible to collect the excess charges only at one single position of such conveying element. Therefore, the best results are achieved if the brush element extends along most of the length of the conveying element so as to receive excess charges from all different parts of such conveying element. However, in case that the absorbent web is in contact with the conveying element in specified regions only, it is also possible to provide several separate brushes which are provided in such specified positions where the absorbent web comes in contact with the conveying element. In such a case, the excess charges are removed at the source, namely where they migrated onto the conveying element during contact with the absorbent web.

In particular embodiments, when using one or more brush elements, the at least one brush element includes fibers predominately consisting of any of the materials of the group consisting of carbon fibers, nylon fibers, natural hair, stainless steel, SUS304 material, acrylic fibers coated with a conductive material like copper or synthetic conductive fibers. This is not an exhaustive list of all possible materials which could be used to form the fibers (bristles or filaments) of the at least one brush element. However, those materials were found to give the best results and to have the highest efficiency in collecting excess static charges.

According to a particular embodiment, the means for consuming the electrical charges is an electrical or electronic component and preferably an LED. As outlined above, an LED starts to consume electricity as soon as a predetermined threshold value of about 6kV is reached which makes an LED very suitable for the given purpose. Moreover, LEDs are easily available, cheep, require no service and occupy very little space inside the housing of a dispenser. A skilled person knows to connect an LED to a wiring and to a source of charge.

The means for neutralising the electrical charges can be preferably in contact with the positively charged element inside the dispenser. According to a particular embodiment, this means for neutralising includes at least one second brush being in contact with the positively charged element. The advantages of a brush were already discussed above. In particular embodiments, the second brush includes fibers as specified above. The first and the second brush elements can have different fibers depending on the material contacted by the brush elements. Among the suitable materials as listed above, the best suitable material should be selected depending on the specific material to be contacted by the bristles or filaments of the individual brushes. Also the configuration of the brushes being either in one piece or in separate individual pieces can be freely selected and needs not to be the same for the first and second brush elements.

If according to a particular embodiment, the positively charged element is the absorbent web, the at least one second brush should be provided with filaments which are soft and bendable so that they do not damage the absorbent sheet product which, in many cases, is a tissue product. In particular embodiments, the second brushes contact both sides of the absorbent web.

BRIEF DESCRIPTION OF THE DRAWINGS

In the following, embodiments of the invention will be briefly discussed, by way of example only, by reference to the accompanying drawings in which:

FIG. 3 schematically show an embodiment of the invention;

FIG. 4 schematically shows a variant of the embodiment as given in FIG. 3;

DESCRIPTION OF PREFERRED EMBODIMENTS

Figure 1:
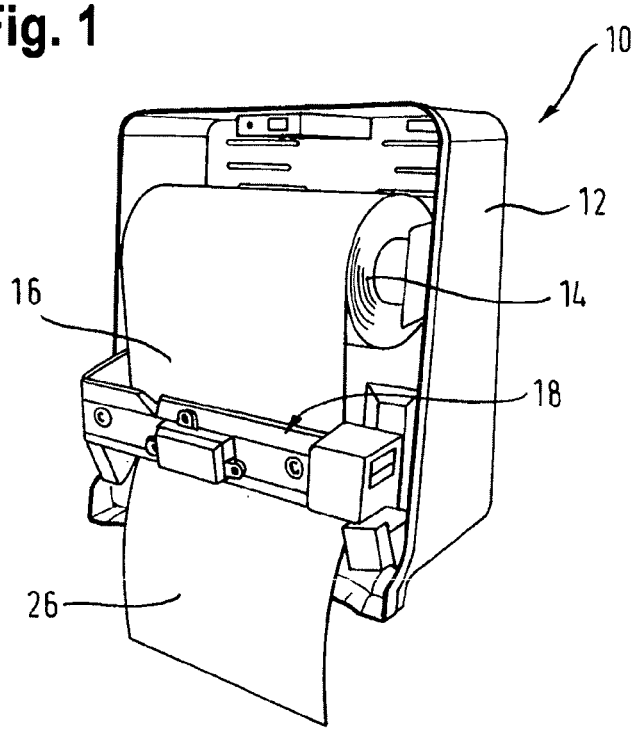
FIG. 1 schematically gives the main components of a conventional dispenser.

Throughout the following embodiments, the same elements will be denoted by the same reference numerals.

FIG. 1 schematically shows a dispenser without its front shell in order to see the main parts of such dispenser.

The dispenser generally denoted by reference numeral 10 has a housing which includes at least two parts. The back shell 12 as shown in FIG. 1 can be affixed to a wall. The front shell (not shown) closes the dispenser and only leaves a slot through which the product can be dispensed.

Inside the dispenser, there is a feed roll 14 on which an absorbent web is wound. This is just an example and, as outlined above, other types of dispensers can also be used to realize the invention, like dispensers in which the absorbent web is stored as a folded stack. In the example dispenser as shown in FIG. 1, the absorbent web 16 is wound from the roll and passes through a conveying unit 18 which mainly includes a drive roll 20, a guide roll 22 and a tear bar 24. The absorbent web leaves the dispenser at position 26 where there is a slot in the front shell of the dispenser through which the absorbent product extends and can be removed by a user.

Figure 2:
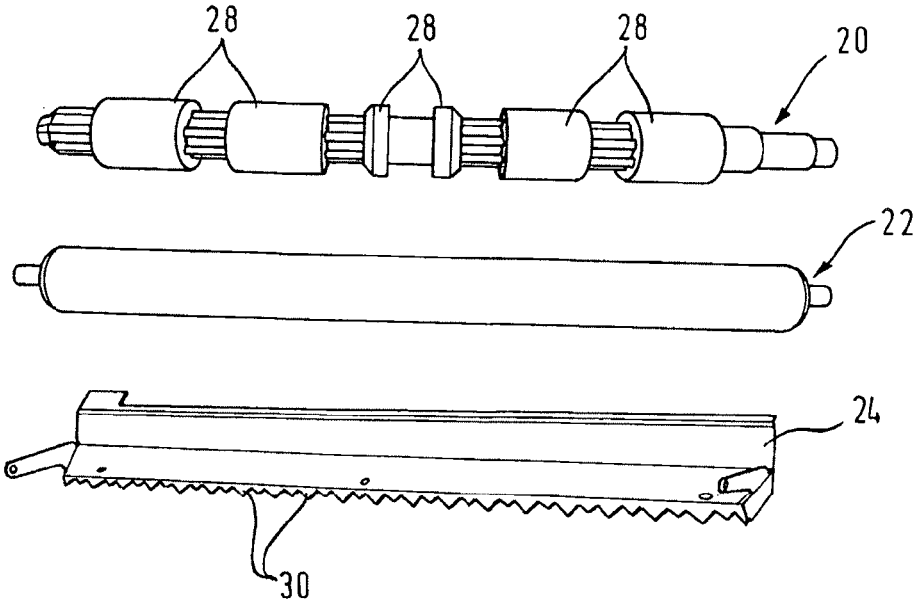
FIG. 2 shows examples of the main parts of a dispenser where a build-up of electrostatic charge can be observed.

The main part of the conveying unit 18 as shown in FIG. 1 are individually exemplified in FIG. 2. The absorbent web to be dispensed passes through the nip between a drive roll 20 and a guide roll which, in FIG. 2, are individually shown without their correct mutual arrangement. In an attempt to provide for a good friction between the conveying unit and the absorbent web, the drive roll might be fully coated by a high friction covering or by rings 28 of a high friction component, like suitable plastic material or rubber. The guide roll can be made of any suitable material which cooperates with the drive roll to achieve a safe transport of the absorbent web between drive roll 20 and guide roll 22.

FIG. 2 also exemplifies the possible size of a tear bar which might be a part of the conveying unit 18 so that the servicing of the dispenser including individual modules might be simplified. However, it is also possible to provide the tear bar 24 separately to the conveying unit. In that case, the tear bar 24 is separately affixed to the housing of the dispenser. Tear bar 24 is provided with cutting teeth 30 which can be used by the user to sever a suitable length of the absorbent web. However, the invention is not restricted to this specific type of dispenser and it is also possible to provide tear bars cooperating with the conveying unit in order to automatically sever a metered length of absorbent sheet.

It has been found that, during operation, most static load builds up at the three components as shown in FIG. 3. Drive roll 20, guide roll 22 and tear bar 24 get negatively charged, whereas the absorbent web, especially tissue paper, leaving the dispenser is positively charged.

FIG. 3 schematically shows a first embodiment. In this embodiment, the absorbent web 16 is transported in the direction of arrow A. It passes through the nip between drive roll 20 and guide roll 22. In order to show the mutual position of the rolls and the brush as described below, the absorbent web 16 is shown in FIG. 3 as if it were translucent.

Due to the frictional transport of the absorbent web 16 between drive roll 20 and guide roll 2, the absorbent web becomes positively charged after leaving the nip between drive roll 20 and guide roll 22. This is schematically shown in position 32 of the absorbent web were "+"-signs are added. At the same time, drive roll 20 becomes negatively charged. This negative static charge in drive roll 20 could build-up to an undesirable extent, whereas the absorbent web leaving the dispenser only has a small positive charge. In an attempt to neutralise the electrical charges, a brush 32 is provided with bristles or filaments which sweep over the circumferential surface of drive roll 20. Such brush is provided with conductive bristles or filaments in order to collect excess electrons corresponding to negative charges from the surface of the drive roll 20. In order to make sure that there is a good contact between the individual filaments and the drive roll, the filaments of the brushes have a length between about 10 mm and 25 mm. This makes it possible to compensate for small positional deviations from the optimum position of the brush 32 and also makes it possible that the bristles or filaments 36 can bend and sweep over the surface of the drive roll 20 in order to increase the contact time between individual positions of the drive roll and the fibers of the brush. The longer the contact between the brush and an individual position on the surface of the drive roll is, the better are the chances that an electron can migrate from the drive roll 20 into the fibers 36 of the brush 32.

The charge collected by the brush 32 is directed to a conducive wire 38 from which it is directed to a second brush 40 which is also provided with fibers 42 (bristles or filaments). The second brush 40 is positioned such as to contact the absorbent web 16 at the position 32 in which the absorbent web is positively charged corresponding to a lack of electrons. The second brush 40 and especially its fibers 42 serve to contact the absorbent web 16 and to neutralise the positive static charge of the absorbent web by supplying a negative charge to the paper web.

The higher the build-up of negative charge on the drive roll 20 is, the more effective will the first brush 34 in contact with the drive roll 20 collect negative charges and the more effective the second brush 40 will be able to reintroduce such negative charges into the absorbent web 16. Therefore, the mechanism as schematically shown in FIG. 3 is highly efficient in order to reduce the build-up of undesired electrostatic charge in the dispenser.

The attachment of the first and second brush at a fixed position relative to the housing of the dispenser needs not to be specified here because this can be easily realized by a skilled person. This easy assembly of the two brushes 34 and 40 as well as the conductive wire 38 inbetween makes it possible to easily modify an existing dispenser in which a high build-up of undesired electrostatic load could be observed.

FIG. 4 exemplifies another embodiment in which there is not one single first brush 34 as shown in FIG. 3. In FIG. 3, brush 34 extends over the whole effective length of drive roll 20. However, as shown in FIG. 2, drive roll 20 can be provided with specific rings 28 of high friction material which serve to contact the absorbent web in cooperation with the guide roll 22. In such a case, the electrostatic load will also build-up in such specific regions 28 of the drive roll 20. Therefore, it is also possible to provide individual, separate brushes 34a to 34d, each of which is provide with a conductive wire collecting the negative charges and transporting it, as shown in FIG. 3 to a suitable means for either neutralising or consuming it.

The fibers of the brushes can be made of a material which is specifically adapted to the component of the dispenser which is in contact to such bristles or filaments. It is easily possible that different materials are best suited for e.g. touching a drive roll 20 or an absorbent web 16. Suitable materials for the fibers (bristles or filaments) of the brushes are carbon fibers, nylon fibers, natural hair, stainless steel, SUS304 material, acrylic fibers coated with copper or synthetic conductive fibers.

The embodiments of FIG. 3 and FIG. 4 always exemplify the collection of negative charges at a drive roll. However, it is likewise possible to arrange one or a plurality of brushes such as to collect such charges from a guide roll or a tear bar which might be operated in a bidirectional movement. However, for a tear bar it might not be necessary to arrange a brush because tear bars can be made of a conductive material so that the electron transport is considerably quicker so that it might be sufficient simply to attach a conductive wire to a tear bar.

Figure 5:
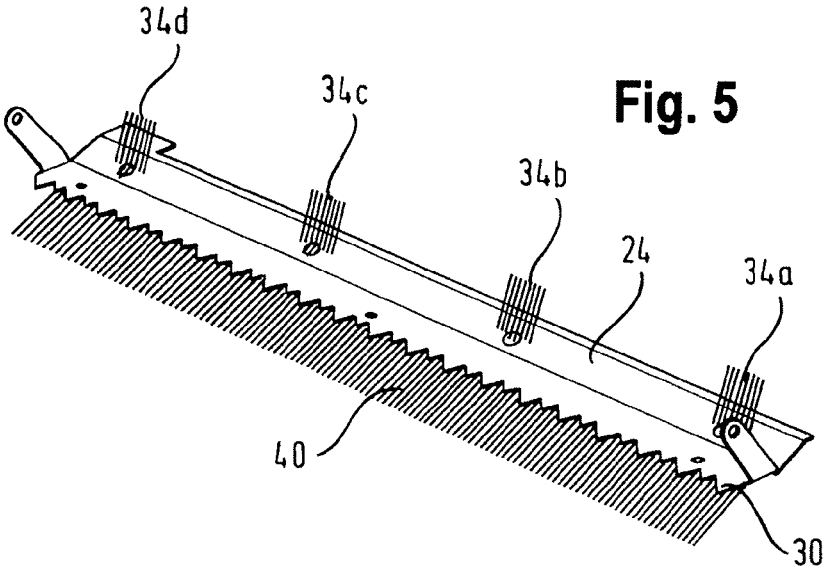
FIG. 5 schematically shows a tear bar with mounted brushes.

FIG. 5 shows a tear bar 24 with cutting teeth 30 which is provided with a plurality of first brushes 34a, 34b, 34c and 34d which are attached to the tear bar. At the same time, there is a second brush 40 also attached to the tear bar. When using such configuration, the tear bar has a multiple function. On the one hand, the first brushes 34a, to 34d sweep the guide roll to connect excess static loads. On the other hand, the second brush 40 sweeps over the paper front in order to reintroduce the excess load into the positively charged paper. Further, the build-up of static load at the tear bar itself is also reduced because not only the excess load collected by the first brushes from the guide roll but also the excess loads building up in the tear bar are reintroduced in the paper web via the second brush 40. It goes without saying that such neutralising function can never be complete. In order to further improve such neutralising function, a further second brush might be used which sweeps over the backside of the absorbent web. In addition to this, not only the guide roll but also the drive roll might be contacted by another first brush to collect negative static load from the guide roll.

Figure 6:
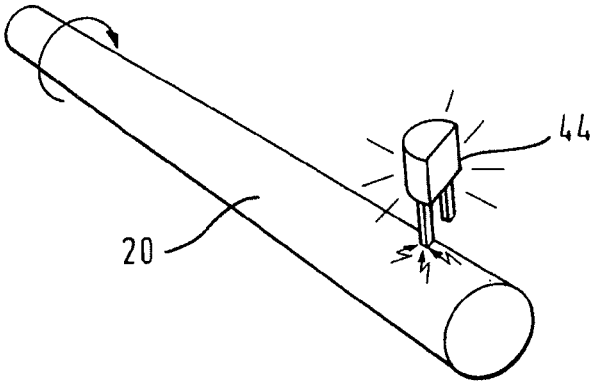
FIG. 6 schematically explains a further embodiment of the invention.
Figure 7:
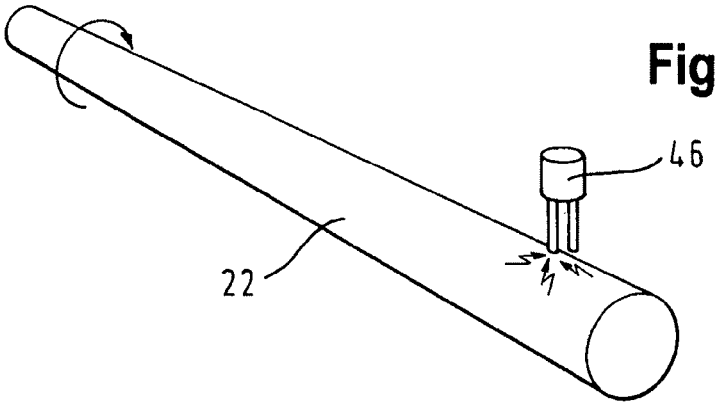
FIG. 7 schematically shows a further embodiment of the invention.

FIGS. 6 and 7 show further embodiments in which the undesirable build-up of static load is not neutralised but consumed. It should be understood that the further embodiments as described in the following can also be used in addition to the embodiments as described above. In the example as shown in FIG. 6, the principle is used that an LED is a low energy consuming light source that can be lightened by the small amount energy that the static electricity generates. If the electrostatically charged part is connected by an electrical wire or in connection with the charged parts, the LED 44 as schematically shown on FIG. 6 in contact to a drive roll 20 could be used to dissipate the charges. FIG. 6 is highly simplified. When realizing the solution according to FIG. 6, it is also advisable to use a brush in order to collect the excess charge from drive roll 20 or any other suitable part of the dispenser and to connect all such brushes via a wiring to the LED in order to energize the LED.

FIG. 7 shows an alternative solution to that as shown in FIG. 6 using an LED. In the example of FIG. 7, another electronic part is used which does not dissipate but stores the energy. In the example as given in FIG. 7, a capacitance 46 collects the excess charges and stores it. The capacitor 26 allows the electrostatic charges to be stored until the power could be used somewhere else in the dispenser, e.g. by using again an LED which could indicate to surface personnel that a high electrostatic load was build-up in a specific dispenser. Again, FIG. 7 is highly simplified. The skilled person will understand that the excess negative charge at the part of the dispenser, here exemplified as a guide roll 22 has to be collected e.g. by means of one or several brushes and guided by a low resistance wiring to another part of the dispenser where the charge is directed to the capacitance 46 and stored there.

The embodiments as described above have in common that the electrical charges building-up in a dispenser are either neutralised or consumed or both neutralised and consumed so as to stay below a critical value which should be avoided in order to damage other electronic components of the dispenser or even expose a user to the discharge of an electrostatic load.

The invention claimed is:

1. A method for modifying an apparatus for dispensing absorbent sheet products comprising a store with an absorbent web which is to be dispensed, a conveying mechanism for feeding the absorbent web, and a severing mechanism for severing the web so as to form absorbent sheet products wherein the method comprises the steps of:

placing a collecting mechanism for collecting electrical charges caused by static electricity in direct contact with a roller of the conveying mechanism inside the apparatus with a negative electrostatic charge; and placing an LED in electrical contact with the collecting mechanism such that the only source of electrical charges to rower the LED is the collecting mechanism.

2. The method according to claim 1, wherein the collecting mechanism comprises a first brush element contacting the roller of the conveying mechanism.

3. The method according to claim 1, wherein the electrical contact is a wire that electrically connects the collecting mechanism and the LED.

4. An apparatus for dispensing absorbent sheet products comprising:

a store with an absorbent web which is to be dispensed;

a conveying mechanism for feeding the absorbent web;

a severing mechanism for severing the web so as to form absorbent sheet products;

a collecting mechanism for collecting negative electrical charges caused by static electricity from the conveying mechanism, the collecting mechanism being in direct contact with a roller of the conveying mechanism;

an LED in electrical contact with the collecting mechanism such that the only source of electrical charges to power the LED is the collecting mechanism.

5. The apparatus for dispensing according to claim 4, wherein another collecting mechanism is attached to the severing mechanism.

6. The apparatus for dispensing according to claim 4, wherein the collecting mechanism comprises a first brush element that is contacting the conveying mechanism.

7. The apparatus for dispensing according to claim 6, wherein the first brush element extends along most of the length of the roller of the conveying mechanism.

8. The apparatus for dispensing according to claim 6, wherein the first brush element includes several separate brushes, the separate brushes are provided at different positions of the roller of the conveying mechanism at locations where the absorbent web comes in contact with the roller.

9. The apparatus for dispensing according to claim 7, wherein a second brush element is attached to the severing mechanism for collecting electrical charges, and wherein at least one of the first brush element and the second brush element comprises fibers selected from the group consisting of carbon fibers, nylon fibers, natural hair, stainless steel, SUS304 material, acrylic fibers coated with a conductive material, and synthetic conductive fibers, and combinations thereof.

10. The apparatus for dispensing according to claim 5, wherein the severing mechanism is a tear bar.

11. The apparatus for dispensing according to claim 4, wherein the first brush element is one single brush.

12. The apparatus for dispensing according to claim 4, wherein the electrical contact is a wire that electrically connects the collecting mechanism and the LED.

* * * * *